US009494166B1

(12) United States Patent
Halfmann

(10) Patent No.: US 9,494,166 B1
(45) Date of Patent: Nov. 15, 2016

(54) JET-GAS LIFT SYSTEM AND METHOD FOR PUMPING WELL FLUIDS

(71) Applicant: Thomas E. Halfmann, San Angelo, TX (US)

(72) Inventor: Thomas E. Halfmann, San Angelo, TX (US)

(73) Assignee: Syphon Energy, LLC, San Angelo, TX (US)

( * ) Notice: Subject to any disclaimer, the term of this patent is extended or adjusted under 35 U.S.C. 154(b) by 0 days.

(21) Appl. No.: 14/978,070

(22) Filed: Dec. 22, 2015

(51) Int. Cl.
*F04F 5/24* (2006.01)
*E21B 43/12* (2006.01)

(52) U.S. Cl.
CPC ..... *F04F 5/24* (2013.01); *E21B 43/124* (2013.01)

(58) Field of Classification Search
None
See application file for complete search history.

(56) References Cited

U.S. PATENT DOCUMENTS 41,158 A 1/1864 Lansdell
2,657,641 A 11/1953 Lung
3,718,407 A * 2/1973 Newbrough ..... E21B 43/124 137/209
3,980,138 A 9/1976 Knopik
4,741,397 A * 5/1988 Weeks ..... E21B 47/0008 166/250.15
5,199,496 A 4/1993 Redus et al.
6,352,109 B1 3/2002 Buckman, Sr.
7,428,929 B2 9/2008 Sherwood et al.
2005/0047926 A1 3/2005 Butler et al.
2006/0045757 A1* 3/2006 Parr ..... F04B 47/04 417/76
2007/0221383 A1 9/2007 Mason et al.
2009/0145608 A1* 6/2009 Croteau ..... E21B 43/124 166/311
2015/0000926 A1* 1/2015 Beg ..... E21B 43/123 166/372
2015/0285271 A1* 10/2015 Beg ..... F04F 5/10 417/194

* cited by examiner

*Primary Examiner* — Jennifer H Gay
*Assistant Examiner* — Caroline Butcher
(74) *Attorney, Agent, or Firm* — Grady K. Bergen; Griggs Bergen LLP

(57) ABSTRACT

A system and method for lifting well fluids to a surface location from a subterranean formation that is penetrated by a wellbore utilizes a tubing string positioned within the wellbore for withdrawing well fluids from the wellbore. A jet-gas pump having a flow tube is in communication with the tubing string. A jet tube located within the interior of the flow tube receives a compressed gas to be discharged from an outlet of the jet tube to create a pressure drop within the flow tube. This facilitates the lifting of well fluids from the tubing string where it is discharged through the flow tube outlet.

24 Claims, 9 Drawing Sheets

JET-GAS LIFT SYSTEM AND METHOD FOR PUMPING WELL FLUIDS

TECHNICAL FIELD

This invention relates to systems and methods for pumping or lifting well fluids from subterranean formations.

BACKGROUND

Lift systems for raising oil from oil wells are often mechanical systems that pressurize the fluid within the well so that the well fluids can be raised to the surface. Referring to FIG. 1, a conventional lift system for an oil well 10 is shown. As shown, a wellbore 12 of the oil well 10 penetrates a subterranean formation 14 to a producing zone 16 of the formation where oil is located. The producing zone 16 may be a zone that has been hydraulically fractured using known fracturing techniques to facilitate oil production.

A casing 18 may be provided to line the wellbore 12. The casing 18 and/or wellbore 12 may be perforated in the producing zone 16 with perforations 20 that allow the flow of well fluids from the producing zone 16 into the wellbore 12 and casing 18.

A tubing string 22 is provided that extends from a wellhead 24 located at the surface and downward through the interior of the casing 18. An inlet 26 of the tubing string 22 extends far down into the well at or adjacent to the lowermost perforations 20 to allow well fluids that enter the perforated casing 18 to enter the lower end of the tubing string 22.

A reciprocating pump assembly 28 (e.g., barrel pump) is provided with the tubing string 22 to facilitate pumping of well fluids upward through the tubing of the tubing string to the wellhead 24. The pump assembly 28 is operated by means of a pump jack 30 located at the surface that is coupled to the pump 28 through a sucker rod 32 that extends from the pump jack 30 through the tubing string 22 to the pump assembly 28 for actuating the reciprocating pump 28.

An annulus 34 surrounds the tubing string 22 and is defined by the space between the exterior of the tubing string 22 and the interior of the well casing 18. Gas 36 may flow through the annulus to the surface where it may be collected at the wellhead 24 and discharged through gas outlet 38.

Oil 40 from the formation is pumped by operation of the reciprocating pump 28 wherein oil and other liquids enter through inlet 26 and are passed upward through the tubing string 22 to the wellhead 24 and discharged through outlet 42. Oftentimes, a gas/liquid separator (not shown) is provided with the tubing string 22 so that gases from the formation are discharged into the annulus 34 before entering the pump 28.

Because the lift system of FIG. 1 requires the use of a mechanical downhole pump assembly 28, the pump assembly is subject to the extreme conditions of the downhole environment. This often leads to pump failure. Sand and grit from the formation that is entrained in the oil tends to wear and damage the components of the pump so that the pump must be routinely removed and repaired or replaced, thus negatively impacting production.

Lift systems that employ downhole pumps, such as those of FIG. 1, also become less efficient when the amount of oil flow from the formation is low. In stripper wells, i.e., wells that produce less than 10 barrels of oil per day, other means are often used to lift the oil from the well. One of these is the gas lift system.

FIG. 2 shows the use of a conventional gas lift system with an oil well 43. The components of the oil well 43 are similar to those of the oil well 10 of FIG. 1, with similar components being labeled with the same reference numerals. In the oil well 43, gas is injected at high pressure into the annulus 34 from a gas inlet 44 at the surface. The tubing string 22 is provided with a series of gas valves 46 located along its length. As injected gas flows downward through the annulus 34 it flows into the uppermost valve 46 so that the gas enters the tubing 22 through the valve 46. This gas mixes with the fluids within the tubing 22 so that the density of the fluids is decreased and they are lifted through the tubing 22 to the wellhead 24 and the liquid/gas mixture is discharged through outlet 48.

As the liquid level within the annulus 34 drops below the uppermost valve 46, it will close and the gas will be introduced into the valve 46 beneath it. As the liquid level continues to drop, each successive valve 46 is closed so that gas from the annulus 34 may enter into the valve where both liquid and gas flow upward through the tubing and out outlet 48.

Like the downhole pump assemblies of FIG. 1, the conventional gas lift system requires the tubing string to extend far into the wellbore, typically terminating at or near the perforations, so that the well fluids can continue to be withdrawn as the liquid level within the annulus drops. The gas lift system also requires the need for added equipment in the form of the mechanical gas lift valves that are provided along the length of the tubing string, thus adding to the complexity and cost of the lift system. Like the reciprocating pump assemblies, the gas valves having moving parts that may also be prone to failure, such as from wear from sand and grit, and may require periodic removal, repair or replacement, which negatively impacts production.

One of the shortcomings of the prior art systems is maintaining proper flow of oil from the formation. In formations that are hydraulically fractured, fractures that radiate from the wellbore into the producing zone(s) facilitate the flow of fluids from the formation. Hydrostatic head pressure from the well fluids in the wellbore help to keep these fractures open. In both the conventional pumping and gas lift systems, the tubing string inlet is located near the perforations and fractures. Continued lifting of fluids therefore causes the liquid levels in the wellbore to be drawn down to the point of where the hydrostatic head pressure that facilitates opening of the fractures is lost and the fractures close. While proppants can facilitate maintaining these fractures open to a certain degree, they are not as efficient opening the fractures as a high hydrostatic head pressure.

Accordingly, a need therefore exists to overcome the shortcomings of these prior art systems.

BRIEF DESCRIPTION OF THE DRAWINGS

For a more complete understanding of the gas jet lift system and method, and the advantages thereof, reference is now made to the following descriptions taken in conjunction with the accompanying figures, in which.

DETAILED DESCRIPTION

Figure 1:
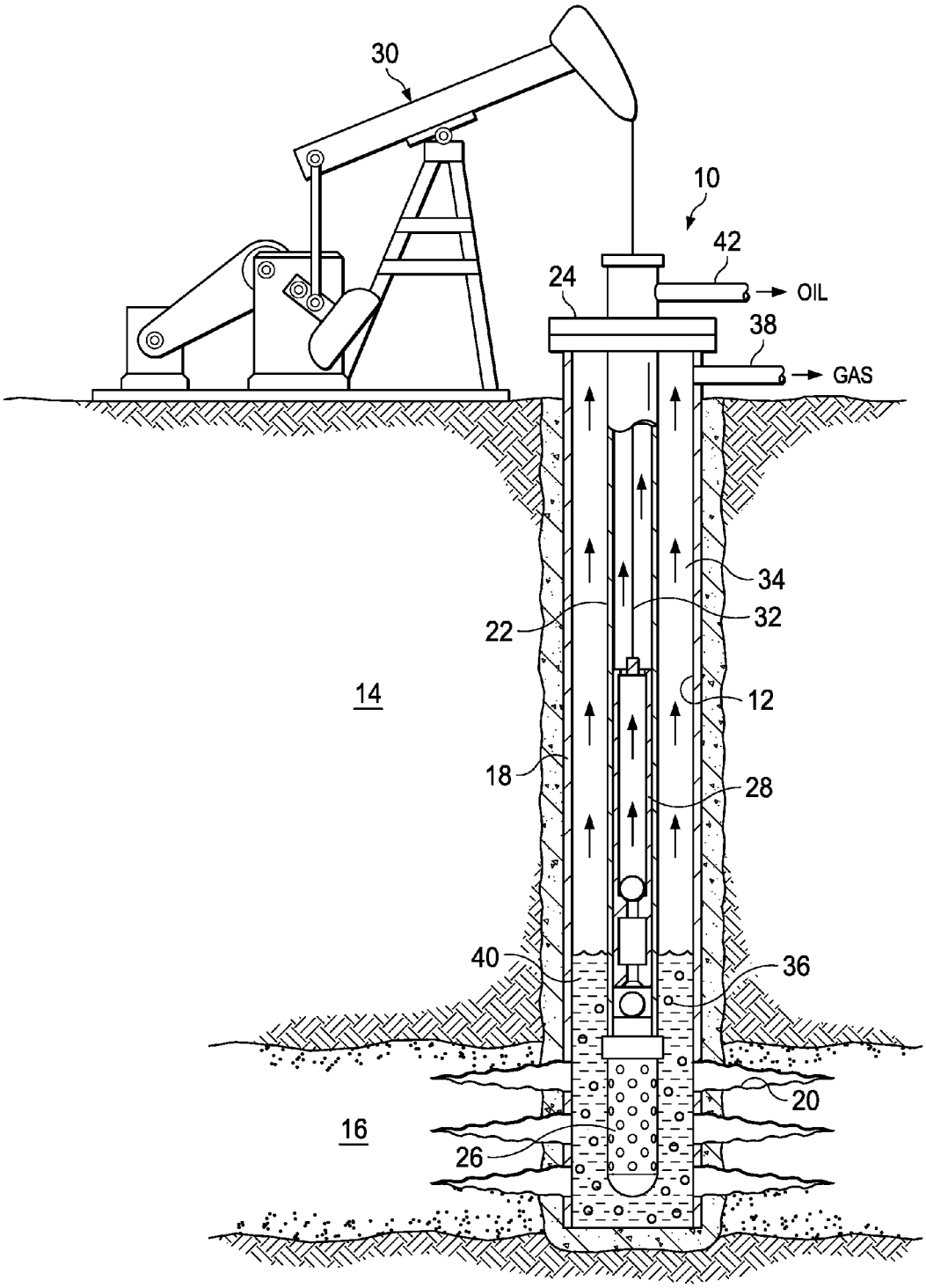
FIG. 1 (PRIOR ART)
FIG. 1 is a schematic representation of an oil well employing a conventional downhole reciprocating pump assembly for lifting well fluids to the surface.
Figure 2:
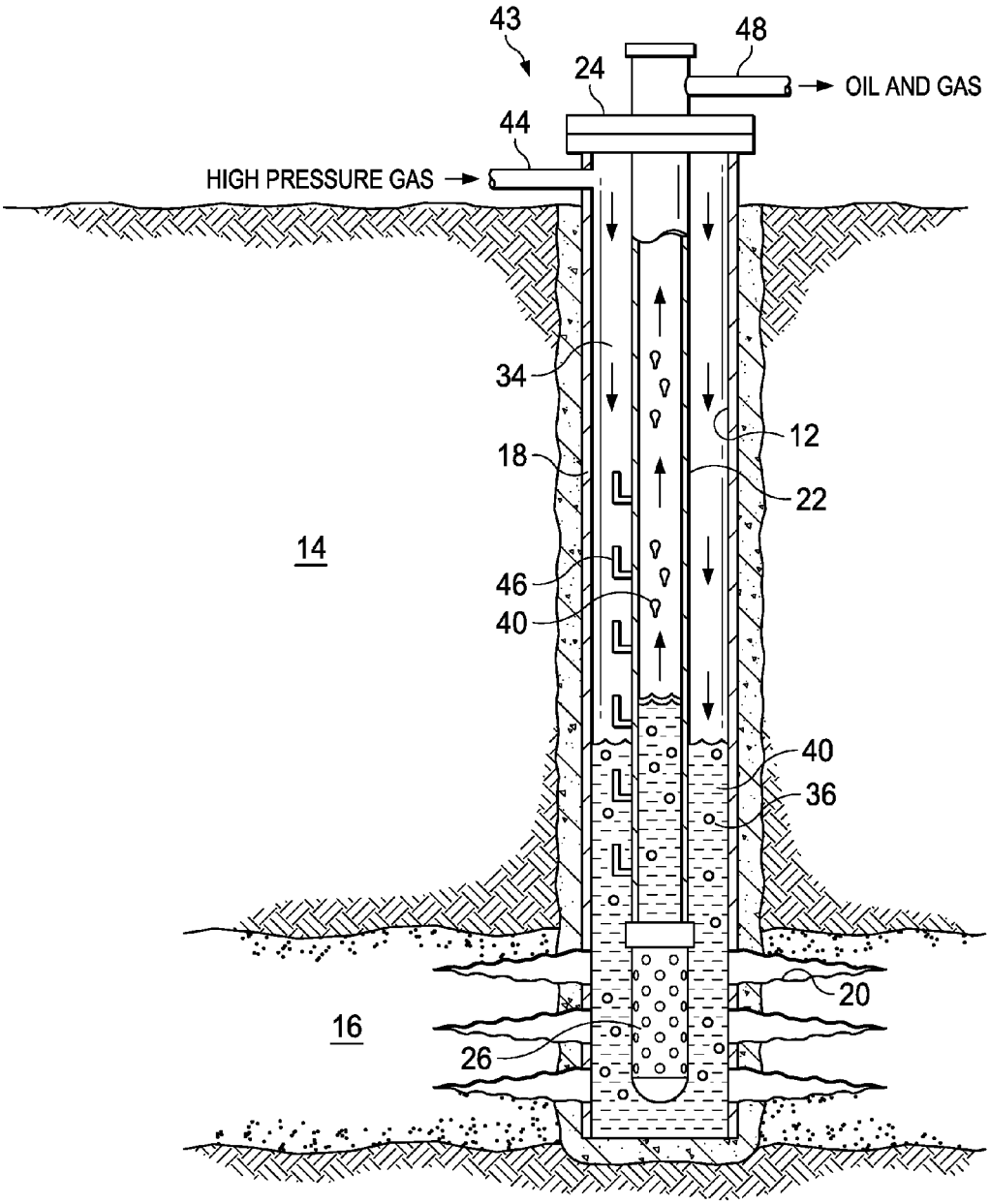
FIG. 2 (PRIOR ART)
FIG. 2 is a schematic representation of an oil well employing a conventional gas lift system for lifting well fluids to the surface.
Figure 3:
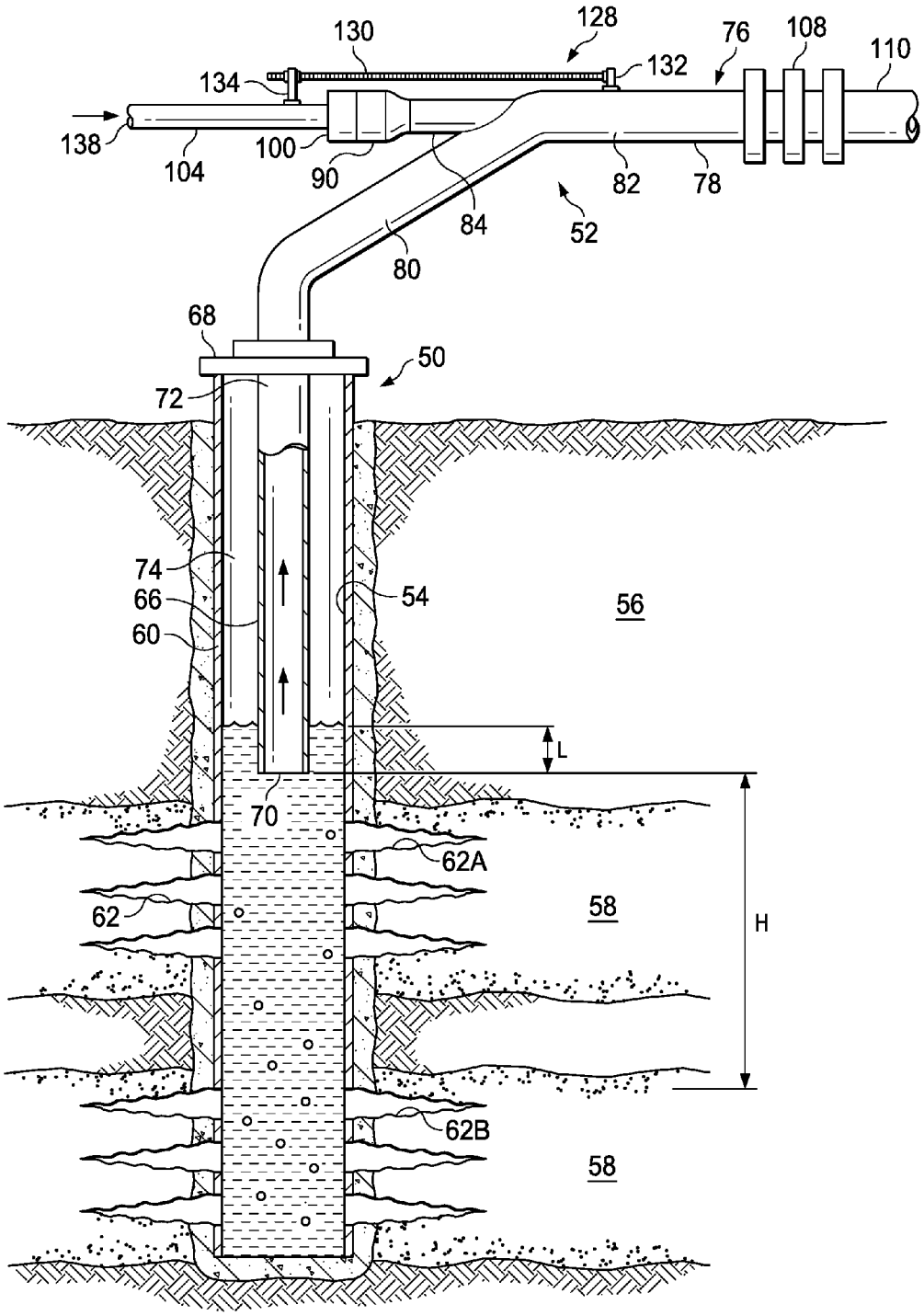
FIG. 3 is a schematic representation of a vertical oil well employing a jet-gas lift system for lifting well fluids to the surface in accordance with the invention.

Referring to FIG. 3, an oil well 50 is shown employing a jet-gas lift system 52 for lifting well fluids to the surface in accordance with the invention. As shown, the oil well 50 includes a wellbore 54 that penetrates a subterranean formation 56 to one or more producing zones 58 of the formation where oil is located. A casing 60 may be provided to line the wellbore 54. The casing 60 and/or wellbore 54 may be perforated in the producing zone(s) 58 with perforations 62 that allow the flow of well fluids from the producing zone 58 into the wellbore 54 and casing 60.

The producing zone 58 may be a zone that has been hydraulically fractured using known fracturing ("fracking") techniques to facilitate oil production. In hydraulic fracturing, fracturing fluids are pumped down the well bore under at a pressure above the fracturing pressure of the formation to create fractures or fissures within the formation that extend from the wellbore. These fracturing fluids are typically pumped through the perforations formed in the casing and wellbore, such as the perforations 62. The formed fractures or fissures facilitate the flow of fluids from the formation, through the perforations and into the wellbore. Because the pressure from the fracturing process is eventually reduced, proppants, such as sand particles, are often pumped into these fractures or fissures during the fracturing process so that when the pressure is eventually released, the sand will help keep the fracture open to facilitate the flow of fluids through the fractures.

In many oil wells, there may be multiple oil producing zones along the length of the wellbore. In each of these zones, the casing and/or wellbore may be perforated and the zone fractured to facilitate oil production from the formation. As shown in FIG. 3, there are two sets or groups of perforations 62A, 62B that are spaced apart along the length of the wellbore 54. In other embodiments, there may be a single set of perforations or three or more sets of such perforations. The perforations 62B constitute the lowermost set of perforations in the vertical wellbore 54.

Figure 4:
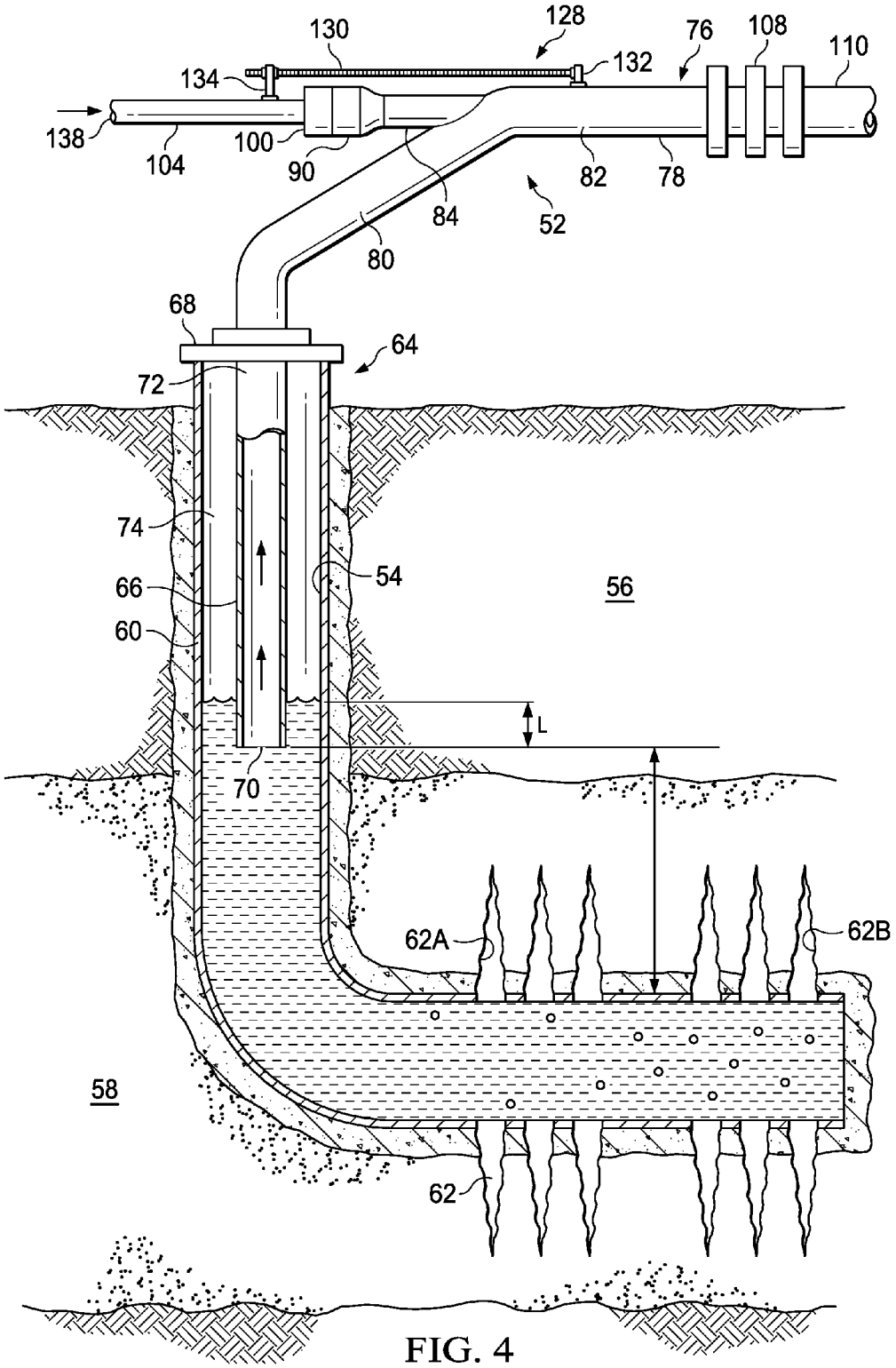
FIG. 4 is a schematic representation of a horizontal oil well employing the jet-gas lift system of FIG. 3.

While the oil well 50 is shown in FIG. 3 as being vertically oriented, FIG. 4 shows a horizontal or non-vertical oil well 64. The oil well 64 of FIG. 4 is similar to the oil well 50 with the same or similar components being labeled with the same reference numerals. In the oil well 64, the lower portion of the wellbore 54 is oriented horizontally or other than a vertical orientation, with the wellbore passing through producing zone 58 as a non-vertical or horizontal section of the wellbore 54. Here the sets of perforations 62A, 62B are located in the horizontal portion of the wellbore 54.

As shown in FIGS. 3 and 4, a tubing string 66 extends downward within the interior of the casing 60 from a wellhead 68 located at or near the surface of the well. The tubing string 66 has a lower inlet 70 that is located at a selected position, which will be discussed later on. An upper outlet 72 of the tubing string 66 facilitates discharging fluids conducted from the lower inlet 70 through the tubing string 66 to the wellhead 68 at the surface. An annulus 74 is defined between the casing 60 and tubing string 66.

A jet-gas pump 76 is provided at the surface for lifting well fluids from the wells 50, 64. The jet-gas pump 76 includes a main flow tube 78 and an inlet section 80 that is coupled to or in fluid communication with the upper outlet 72 of the tubing string 66 through the wellhead 68. As shown, the inlet section 80 joins the rearward end 82 of the main flow tube 78 and is angled away from the main flow tube 78 to accommodate a jet tube receiver 84 coupled to the rearward end 82 of the main flow tube 78.

Figure 5:
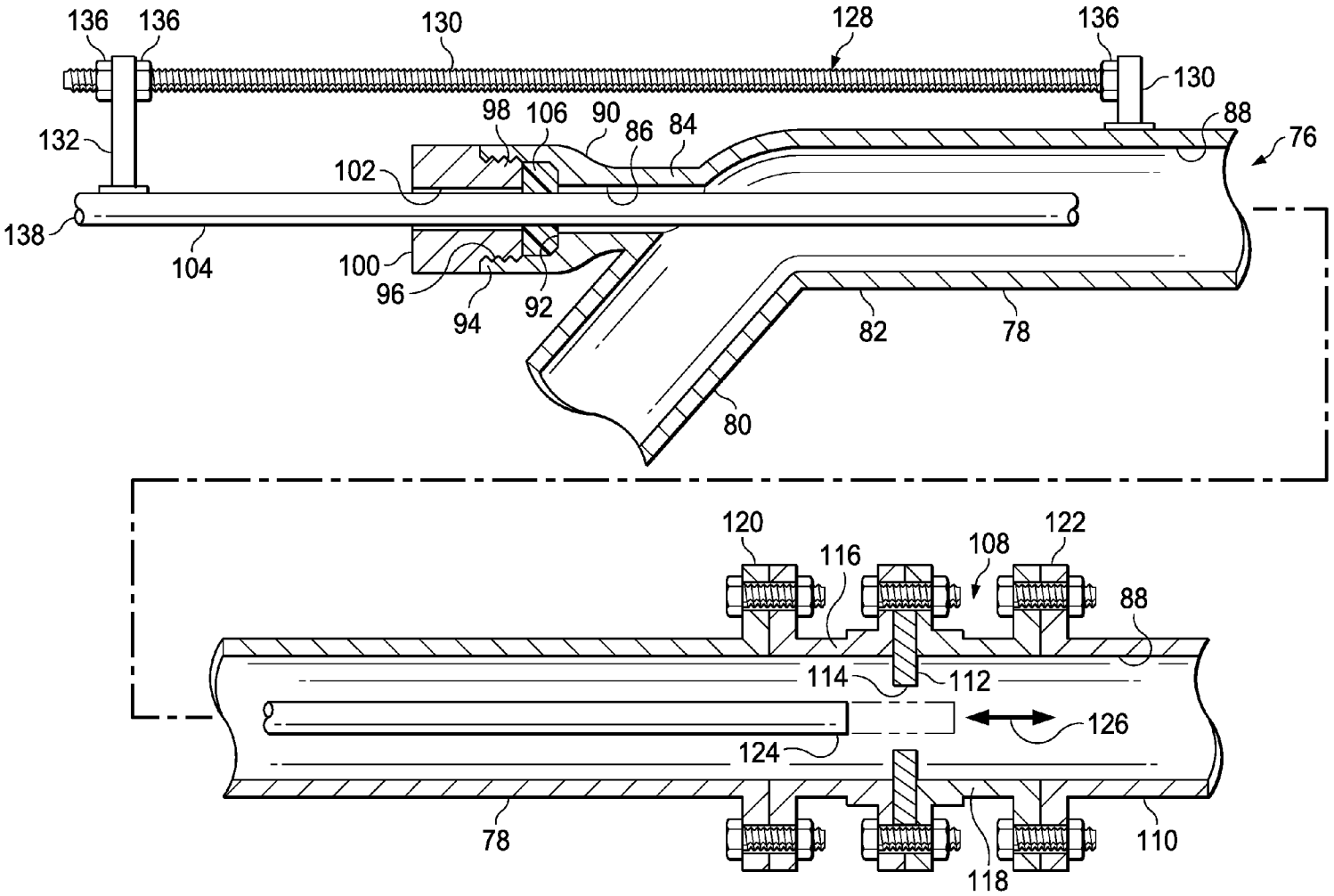
FIG. 5 is a longitudinal cross-sectional view of a jet-gas pump of the jet-gas lift system employed in the jet-gas lift system of FIG. 3.

Referring to FIG. 5, the jet tube receiver 84 has a central passage 86 that communicates with an interior central passage 88 of the main flow tube 78. The central passage 86 is generally concentric with the central passage 88 of the main flow tube 78. In the embodiment shown, the jet tube receiver 84 has a receiver head 90 that is provided with an annular shoulder 92 that extends radially outward and surrounds the central passage 86. An annular collar 94 extends from the periphery of the shoulder 92. An internally threaded portion 96 is provided on the end of the collar 94 for engaging the externally threaded end portion 98 of a locking nut 100 that couples to the collar 94. The locking nut 100 also has a central passage 102 that is aligned with the central passage 86 of the receiver when the locking nut 100 is coupled to the collar 94.

A jet tube 104 of the jet-gas pump 76 extends through the central passages 102, 86 of the locking nut 100 and receiver 84, respectively, and into the interior central passage 88 of the main flow tube 78. An elastomeric or resilient annular seal or gasket 106 is provided within the collar 94 of the receiver 84 and seats against the annular shoulder 92. The seal or gasket 106 closely receives and surrounds the jet tube 104. When the threaded end portion 98 of the locking nut 100 is tightened it compresses the seal or gasket 106 against the shoulder 92 so that it expands against the jet tube 104 forming a fluid-tight seal around the exterior of the jet tube 104 and sealing off the central passage 86 of the receiver 84 surrounding the jet tube 104.

Figure 6:
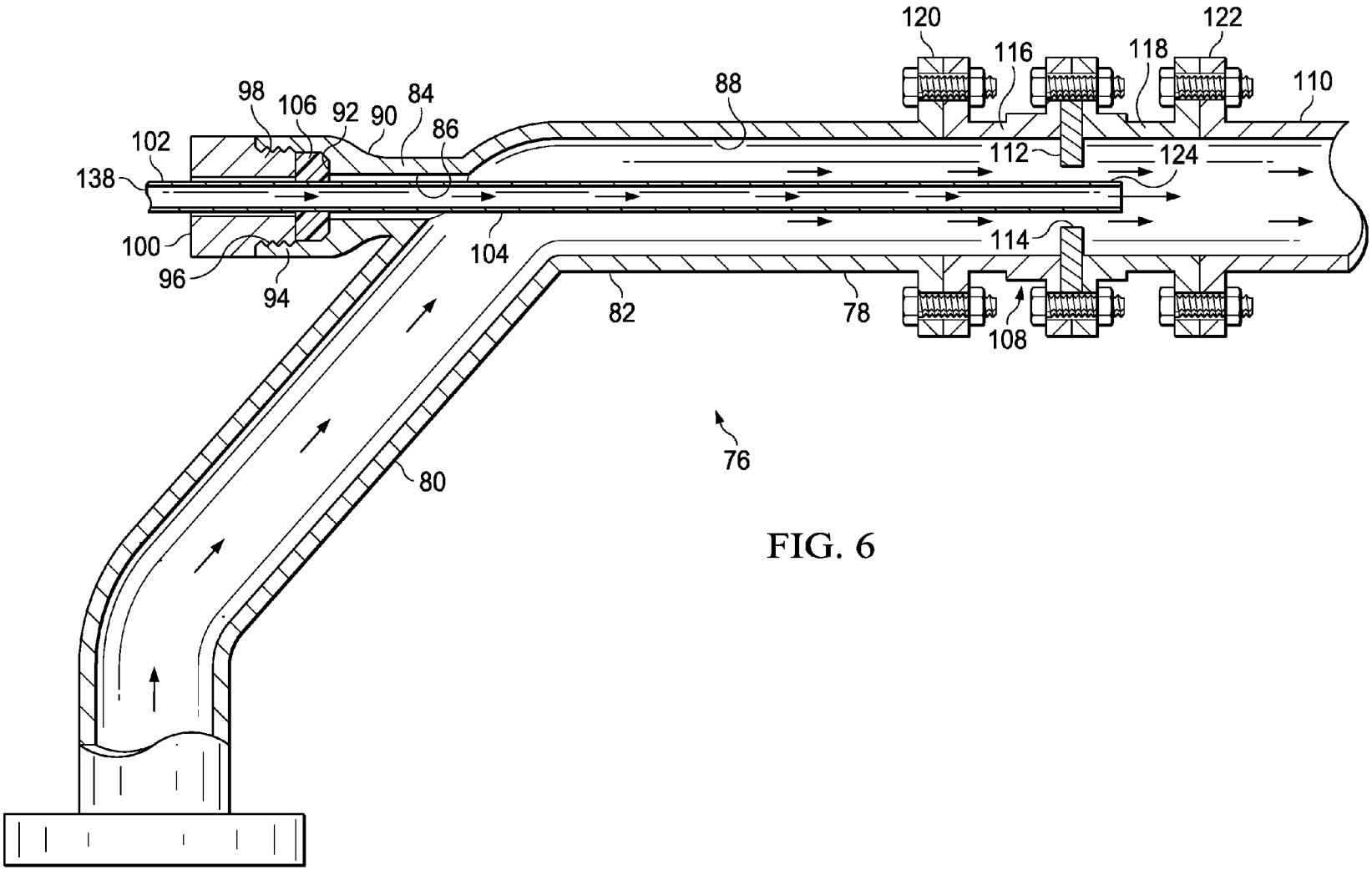
FIG. 6 is longitudinal cross-sectional view of the jet-gas pump of FIG. 3 shown with an inlet flow tube and the jet-tube pump in cross section.

The main flow tube 78 is provided with a venturi assembly 108 located between the inlet 80 and an outlet 110 of the flow tube 78. The venturi assembly 108 is shown in FIGS. 5 and 6 as being formed from an orifice plate 112 having an orifice 114 formed as a circular central passage that provides a constriction having a defined cross-sectional flow area that constricts the flow area within the flow tube 78 between the flow tube inlet 80 and the outlet 110 of the flow tube 78. The venturi assembly 108 may be held in place by flanged mounts 116, 118 that secure to flanged portions 120, 122 of the main flow tube 78.

While the size of the restriction created by the orifice 114 may vary, in certain applications, the ratio of the cross-sectional flow area of the flow tube 78 on either side of the venturi assembly 108 to the cross-sectional flow area of the constriction formed by the orifice 114 may range from 1.5:1 to 3:1, with from 2:1 to 2.5:1 being useful in more specific embodiments. As an example, in practice a main flow tube 78 having internal cross-sectional diameter of approximately 3 inches may be used with an orifice plate 112 having a central orifice 114 with an approximate diameter of 2 inches, which would provide a ratio of cross-sectional flow areas of approximately 2.25.

As shown in FIGS. 5 and 6, an outlet 124 of the jet tube 104 projects into the interior of the flow tube 78 and is aligned with and terminates at or adjacent to the orifice 114 of the venturi assembly orifice plate 112. The jet tube 104 is selectively movable in relation to the flow tube 78 so that the outlet 124 can be selectively positioned at different positions relative to the orifice 114, as shown by the arrow 126 (FIG. 5). As shown in FIG. 5, the outlet 124 is located at a position upstream of the orifice 114. In FIG. 6, the jet tube 104 is shown being passed through the orifice 114 so that the outlet 124 is at a position downstream of the orifice 114. In other instances, the outlet 124 may be located at a position directly within the orifice 114. Typically, the outlet 124 of the jet tube 104 will be positioned no further than a few inches from the orifice 114 and so that the gas discharged from the outlet 124 serves as a motive fluid for moving fluids within the main flow tube 78.

Movement and positioning of the jet tube 104 in relation to the flow tube 78 and orifice 114 is accomplished by loosening the locking nut 100 so that pressure is relieved on the seal or gasket 106. This loosens the seal around the jet tube 104 and allows the jet tube 104 to be slid within the receiver 84 and the flow tube 78 so that the outlet 124 can be moved linearly to various positions relative to the orifice 114 of the venturi assembly 108. When the jet tube 104 is moved to the desired position, the locking nut 100 may be retightened to compress the seal or gasket 106 against the exterior of the jet tube 104. In other embodiments, different configurations may be used to allow the jet tube 104 to be received within the main flow tube 78 and allow linear movement without loosening or disengaging seals that surround the flow tube 78.

A jet tube positioning assembly 128 may also be provided to facilitate securely holding the jet tube 104 in position once it has been moved to the desired position relative to the flow tube 78 and orifice 114. In the embodiment shown, the jet tube positioning assembly 128 utilizes a threaded member 130 (e.g., all thread) that is coupled at one end to a mount or bracket 132 coupled to the flow tube 78 and at the other end to a mount or bracket 134 coupled to the jet tube 104. One or both of the mounts or brackets 132, 134 is provided with an aperture (threaded or non-threaded) that receives the threaded member 130. Threaded locking nuts or devices 136 of the jet tube positioning assembly 128 may be used to secure the member 130 in place with respect to the mounts or brackets 132, 134. This configuration allows the member 130 to be selectively moved through the aperture(s) of the mounts 132, 134 so that the jet tube 104 can be moved to various positions with respect to the flow tube 78, with the threaded member 130 accommodating the movement of the jet tube 104 and holding the jet tube 104 in place once the jet tube 104 is moved to the desired position. Other positioning assemblies or systems may also be used for holding the jet tube 104 in position, as well.

The outlet 124 of the jet tube 104 has a defined outer cross-sectional area that is less than the cross-sectional flow area of the orifice 114 of the orifice plate 112. While the size of the outlet 124 of the jet tube 104 may vary, in certain applications, the ratio of the cross-sectional flow area of the orifice 114 of the orifice plate 112 to the outer cross-sectional area of the outlet 124 of the jet tube 104 may be from 2:1 to 6:1, with from 3:1 to 5:1 being useful in more specific embodiments. As an example, in practice a flow tube 78 having internal cross-sectional diameter of approximately 3 inches may be used with an orifice plate 112 having an orifice 114 with an approximate diameter of 2 inches. This may in turn be used with a jet tube 104 having an outer cross-sectional diameter of approximately 1 inch. It should be noted that the cross-sectional flow area (i.e., internal cross-sectional area) of the jet tube outlet 124 will be less than the outer cross-sectional area. This will typically be from about 30% to 50% or more of the outer cross-sectional area of the jet tube outlet 124 due to the reduction in area, such as due to the pipe wall thickness. The outlet 124 of the jet tube 104 essentially forms a nozzle. In some cases, the cross-sectional flow area (i.e., internal cross-sectional area) of the jet tube outlet 124 is from 50% to 95% of the outer cross-sectional area of the jet tube outlet 124. For example, for a standard 1-inch schedule 40 steel pipe having an OD of 1.32 inch and an ID of 1.05 inch, the outer cross-sectional area would be approximately 1.36 $in^2$ with an internal cross-sectional flow area of 0.87 $in^2$, which is about 64% of the outer cross-sectional area. The end portion of the jet tube 104 near the outlet 124 that is allowed to project through the orifice 114 may be of constant diameter.

Figure 7:
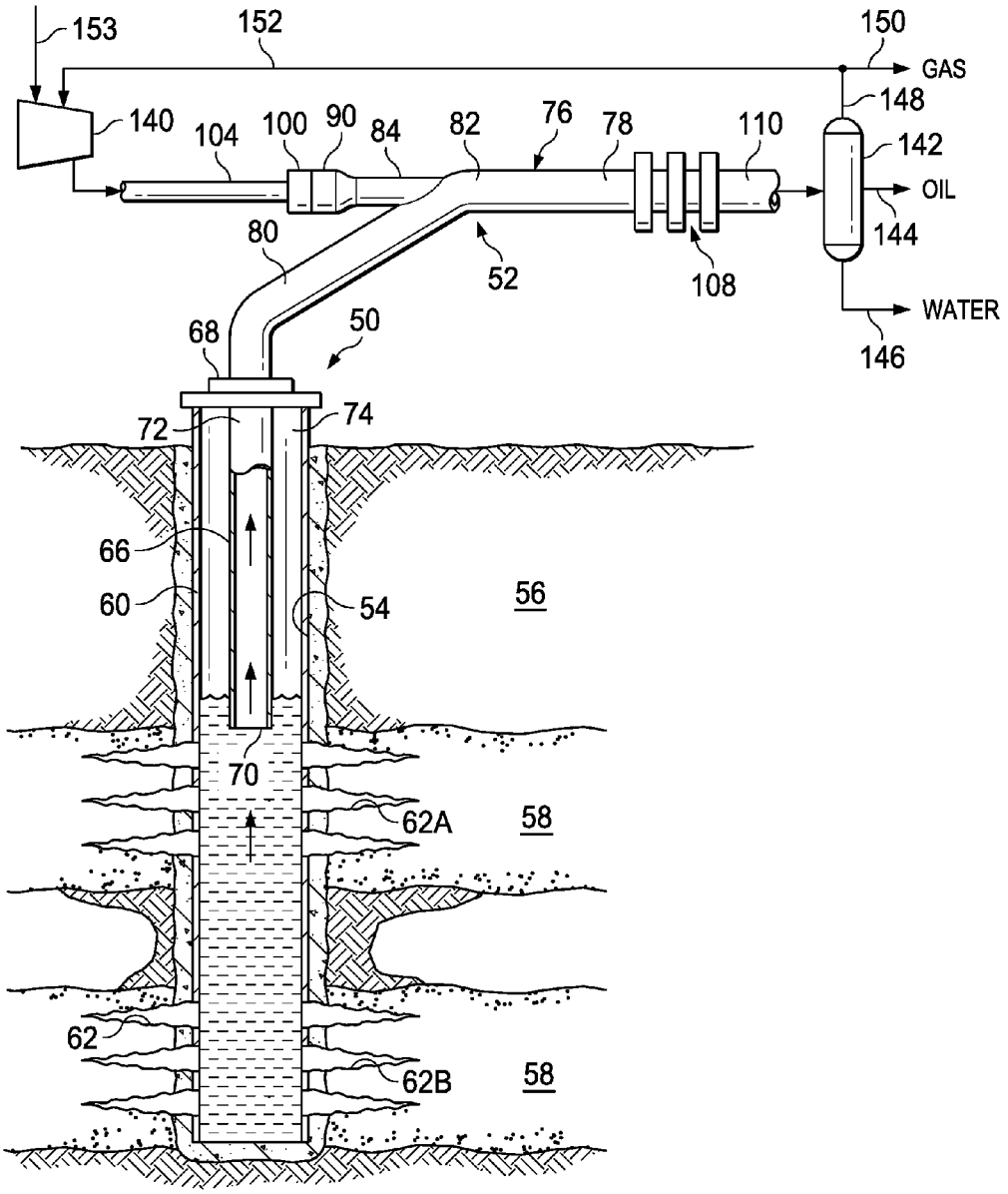
FIG. 7 is a schematic representation of an oil well employing a jet-gas lift system for lifting well fluids to the surface, shown with a gas/liquid separation unit and recycle system for separating gas and liquids and recycling gas for use in the jet-gas lift system.

Referring to FIG. 7, the jet tube 104 has an inlet 138 that is fluidly coupled to a compressed gas source, such as the compressor 140 for introducing high pressure gas into the jet tube 104. For oil wells, the gas will typically be a hydrocarbon gas, such as natural gas. The flow of gas from the compressor 140 to the jet tube 104 may be controlled by means of control valves (not shown) to regulate and control the flow of gas.

Referring to FIG. 6, the high pressure gas flows from the inlet 138 through the jet tube 104 and out jet tube outlet 124. The gas from the jet tube outlet 124 serves as a motive fluid entraining and moving the fluids within the main flow tube 78. As fluids pass through the constriction formed by the orifice 114, a low pressure zone is produced that produces suction or a pressure drop within the rearward end 82 of the main flow tube 78. The outlet 124 of the jet tube 124 may be positioned to provide varying flow. In certain instances, the jet tube outlet 124 may be located upstream of the orifice 114, as shown in FIG. 5. In other instances, the jet tube outlet 124 may be located downstream of the orifice 114 so that the jet tube 104 actually further constricts the flow area of the orifice 114, as shown in FIG. 6. In still other embodiments, the outlet 124 of the jet tube may be located immediately at or within the orifice 114 itself (not shown). By moving the jet tube 104, as indicated by the arrow 124 (FIG. 5), the outlet 124 can be moved to different positions relative to the orifice 114 to adjust the amount of suction that is provided to lift fluids from the flow tube inlet 80 from a given flow of gas through the jet tube 104.

With the upper outlet 72 of the tubing string 66 coupled to the flow tube inlet 80, fluids are lifted from the lower inlet 70 of the tubing string 66. The lower inlet 70 is located in a vertical portion of the wellbore 54. The position of the lower inlet 70 may be selected to provide optimal recovery of well fluids in accordance with the invention. As shown in FIG. 3, in a vertical well, the lower inlet 70 may be located at a height H measured from the bottom set of perforations 62B formed in the wellbore 54 of a vertical wellbore. Similarly, as shown in FIG. 4, where the perforations are formed in a horizontal portion of a wellbore, the lower inlet 70 may be located at a height H measured from where the horizontal portion of the wellbore 54 meets the vertical portion of the wellbore. In such case, the horizontal portion of the wellbore 54 where it meets the vertical portion essentially acts as the lowermost set of perforations. This height H may be from 50 feet, 75 feet, 100 feet, 150 feet, 200 feet, 250 feet, 300 or more. In certain embodiments, the height H may be from 300 feet to 1000 feet or more. In other embodiments, the height H may be measured from the uppermost zone of perforations, such as the perforations 62A, with the height H being from 50 feet, 75 feet, 100 feet, 150 feet, 200 feet, 250 feet, 300 or more from such perforations. In certain embodiments, the height H may be from 300 feet to 1000 feet or more as measured from the uppermost zone of perforations.

In certain embodiments, to facilitate optimal recovery, the location of the lower inlet 70 of the tubing string 66 may also be set based upon the flow characteristics of the well itself. After a well is completed it may be shut in wherein the wellhead 68 is closed off. When the well is shut in, well fluids will flow from the formation through any formed fractures and into the wellbore and casing. As gases and well fluids flow from the formation, the wellbore pressure within the wellbore and casing will typically rise as the fluids are pushed upward through the wellbore. This pressure will typically peak and the liquid level within the casing will become static. This is often referred to as the "static fluid level." FIGS. 3 and 4 show the liquid level, which may be the static fluid level, in relation to the lower inlet 70 of the tubing string as measured by the distance L. Once the static fluid level is known, the tubing string 66 can be set so that the lower inlet 70 is a the selected distance L from the fluid level. The distance L of the lower inlet 70 from the static fluid level may be from 200 feet, 150 feet, 100 feet, 75 feet, 50 feet, 25 feet, 10 feet or less. The lower inlet 70 may be below or above the liquid level, so that the distance L may be the distance of the inlet 70 either above or below the liquid level. Thus, although the lower inlet 70 is shown in FIGS. 3 and 4 as being below the liquid level, in other instances it may be located above the liquid level.

In other embodiments, the tubing string 66 may be very short with the inlet 70 of the tubing string 66 being located at or near the wellhead 68. The inlet 70 may be from 50 feet, 25 feet, 15 feet, 10 feet, 5 feet or less from the wellhead 68 located at the surface. In certain instances, the tubing string 66 may be eliminated entirely, with the inlet being formed from an inlet of the wellhead itself.

With the lower inlet 70 of the tubing string 66 positioned at the desired position, the jet-gas pump 76 can be operated to lift well fluids to the surface. In operation, gas from the compressor 140 is introduced into the jet tube 104 so that the low pressure created in the main flow tube 78 and flow tube inlet 80 creates suction, drawing fluids from the wellbore 54 and/or casing 60 into the tubing string 66 through inlet 70. Adjustments to facilitate the amount of suction may be made by moving the jet tube 104 relative to the orifice 114. Additionally, regulation of the flow of gas to the jet tube 104 from the compressor 140 may also be used, such as through regulating the compressor 140 or the flow from the compressor 140 through the use of flow control valves (not shown), etc.

The jet-gas pump 76 may be operated continuously to provide a continuous flow of fluids from the wellbore 54. The jet-gas pump 76 may be adjusted during operation to keep the level of liquid within a certain distance L from the lower inlet 70, such as from 200 feet, 150 feet, 100 feet, 75 feet, 50 feet, 25 feet, 10 feet or less. Sensors to monitor the liquid level within the well may be provided, which may be coupled to controls of the jet-gas lift system to adjust the operation of the lift system 52 to control the lifting of fluids so that the liquid level is maintained within a selected level. This allows the liquid level to be maintained at a sufficient height to provide a substantial head pressure within the wellbore. Additionally, the annulus 74 is closed off at an upper end at the wellhead 68 to facilitate pressurizing the annulus during the lifting of well fluids. Closing off the wellhead 68 and annulus 74 and providing a higher liquid level also helps to maintain pressure within the wellbore. The increased pressure helps to keep the fractures of the formation open so that they do not close, thus resulting in more fluids being produced and delivered to the wellbore 54.

The suction created by the jet-gas pump 76 will draw both gas and liquids (i.e., liquid oil and water). Because gas is separated at the surface, there is no need for the use of liquid/gas separators downhole, as with some conventional pumping systems.

Additionally, because the lower inlet 70 is located at a position that may be well above the perforations, such as the perforated zones 62A, 62B, sand, grit and other particles that is often entrained within the pumped fluids in conventional pumping systems, typically settles out before reaching the lower inlet 70. Thus, there is no need for devices, filters or other equipment downhole for separating sand or other particles from the well fluids that would typically damage downhole pumping equipment. As a result, the lower inlet 70 and/or tubing string 66 may be free of any sand filtration or sand removal equipment.

The outlet 114 of the flow tube 78 may be fluidly coupled to a separation unit 142. The separator 142 facilitates the separation of gas and liquids. In certain cases, the separation unit 142 or an additional separation unit may further separate oil and water, with oil 144 being removed in one stream and water 146 being removed in another stream for collection and/or processing. A gas stream 148 from the separator 142 may be removed and collected, such as at 150. In some embodiments, all or a portion of the gas stream 148 may be recycled 152 to the compressor 140. Alternatively or in addition, a further gas stream 153 may be supplied to the compressor 140 from other gas sources.

Figure 8:
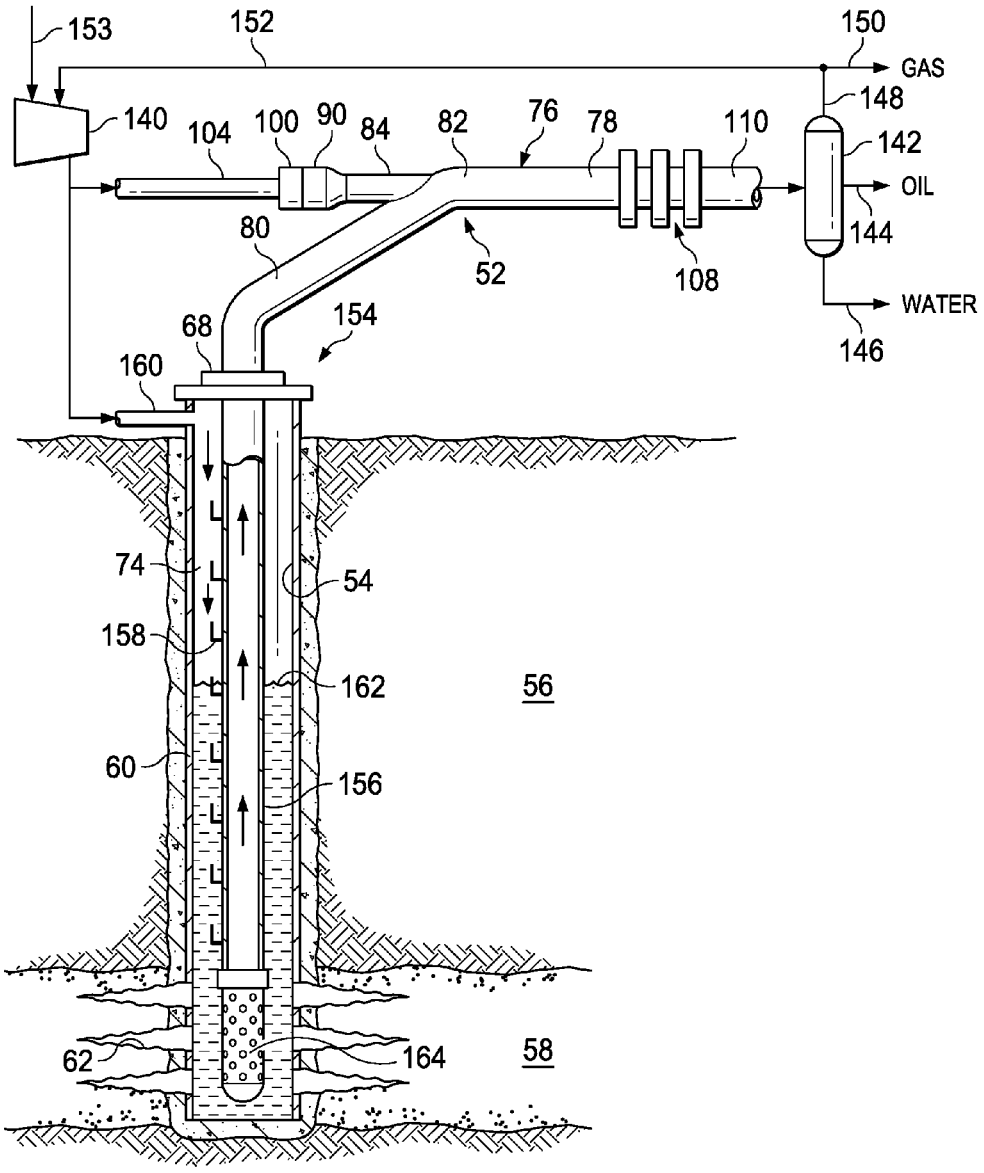
FIG. 8 is a schematic representation of an oil well employing a jet-gas lift system for lifting well fluids that is used in combination with an annular gas-flow lift system.

Referring to FIG. 8, another embodiment of an oil well 154 is shown. The oil well 154 is similar to the oil well 50 with similar components labeled with the same reference numerals. The oil well 154 also utilizes a jet-gas pump 76 that is configured similarly to that of well 50. The well 154 differs, however, in that it is provided with a tubing string 156 that is provided with a series of gas valves 158 located along its length. In the oil well 154, gas is injected at high pressure, such as from compressor 140, from a gas inlet 160 into the annulus 74. As injected gas flows through the annulus 74 it flows into the uppermost valve 158 so that the gas enters the tubing 156 through the valve 158. This gas mixes with the fluids within the tubing 156 so that the density of the fluids is decreased and they are lifted through the tubing 156 to the wellhead 68 and the liquid/gas mixture. The jet-gas pump 76 assists and facilitates further lifting of these fluids as well.

As fluids are lifted, the liquid level 162 drops below the uppermost valves, with the valves above the liquid level 162 sequentially closing with the drop in the liquid level. Because the liquid level 162 is required to drop, the inlet 164 of the tubing string 156 may be located at or near the lowermost perforations 62 to ensure that the liquids are removed.

Figure 9:
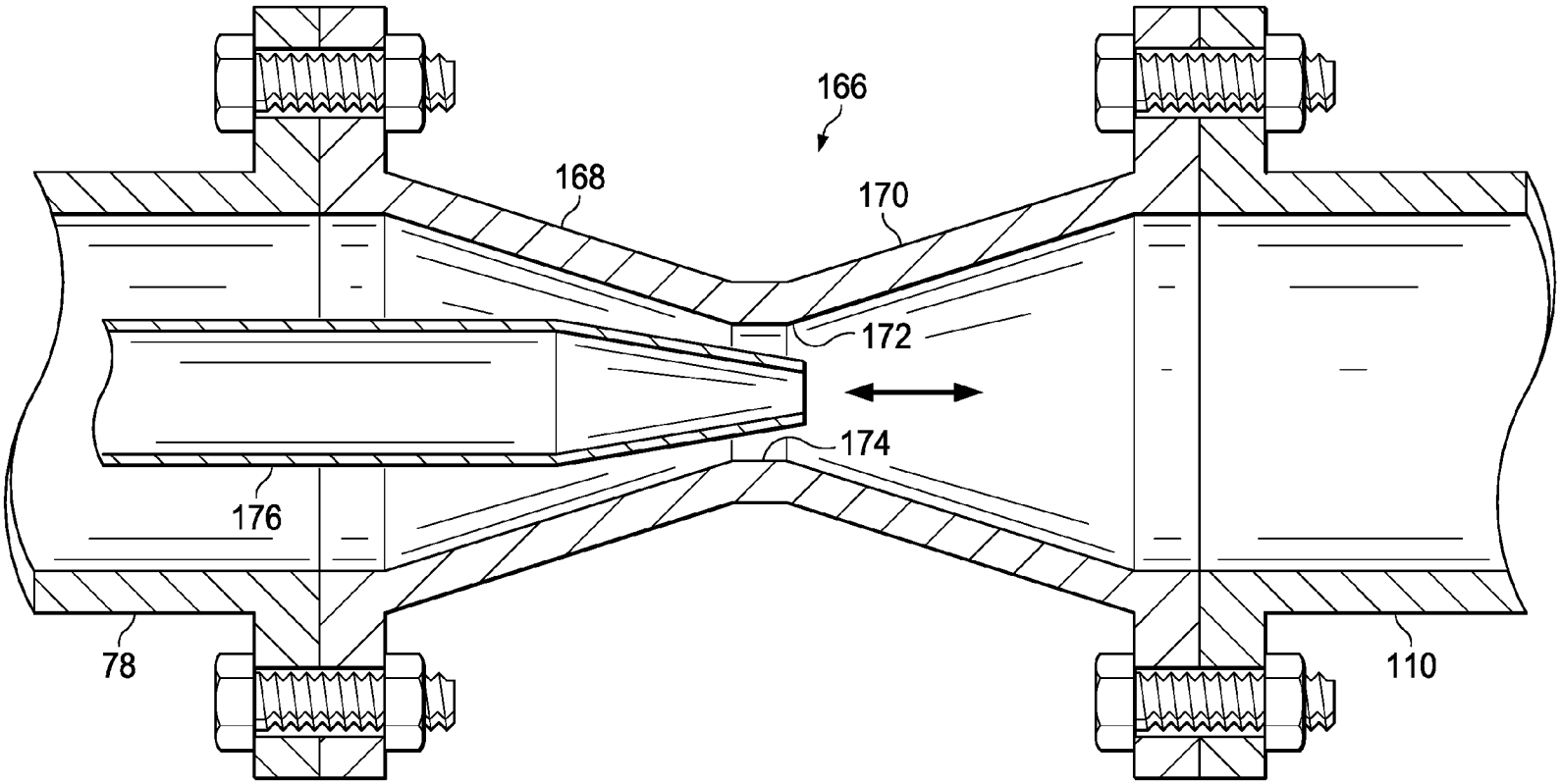
FIG. 9 is a longitudinal cross-sectional view of an alternate embodiment of a venturi assembly for use in a jet-gas pump.

FIG. 9 shows an alternate embodiment of a venturi assembly 166 that may be used in place of the venturi assembly 108 of jet-gas pump 76. As shown, the venturi assembly 166 utilizes tapered or frusto-conical upstream and downstream sections 168, 170 that narrow to a constriction 172 that forms an orifice 174, which may be similarly sized to the orifice 114 of orifice plate 112, previously described.

Additionally, an alternate embodiment of a jet tube 176 is shown in use with the venturi assembly 166. The jet tube 176 is similar to the jet tube 104 but is provided with a tapered or frusto-conical outlet 178. As shown, the tapered outlet 178 may also be tapered internally so that the jet tube outlet 178 is smaller in diameter than the rest of the jet tube 176. This may facilitate increasing the velocity of gas discharged from the jet tube 176. The jet tube 176 is also movable relative to the orifice 174. By linearly moving the jet tube 176, the jet tube outlet 178 can be moved to various positions relative to the orifice 174. Because of the taper of the outlet 178, the cross-sectional flow area between the orifice 174 and the tapered outlet 178 when a portion of the outlet 178 is located within the orifice 174 can be varied by adjusting its position.

In an alternate embodiment, the jet tube 176 of FIG. 9 may be used with the venturi assembly 108 of FIGS. 5 and 6. Similarly, in another alternate embodiment, the venturi assembly 166 of FIG. 9 may be used with the jet tube 104 of FIGS. 5 and 6 with the non-tapered outlet 124.

The jet-gas lift system provides particular advantages over the prior art lift systems. The lift system can be used in both high and low flow (e.g., stripper wells) wells. Because the annulus of the well remains sealed or closed, pressure within the wellbore can be maintained as fluids are removed. The lift system allows continual removal of fluids without significantly dropping the liquid level within the wellbore. This results in increased head pressure from the liquid fluid column within the wellbore and helps to keep the pressure within the well elevated so that the fractures remain open, thus allowing more fluids from the formation to flow to the wellbore. This is contrasted with the conventional systems that continue to pump or lift liquids so that the liquid level drops to the inlet of the tubing string. This drop in liquid level reduces the pressure within the wellbore so that the fractures close and less fluids can flow from the formation.

The lift system of the invention also allows the tubing string inlet to be located at a position well above the perforations of the wellbore. Having the inlet located at a far distance from the perforations allows sand or particles that become entrained within the well fluids to settle out before they are introduced into the tubing string. This is contrasted with the prior art systems where the inlet is typically locate at or near the perforations, increasing the likelihood that sand and particles are introduced into the pumping equipment and tubing string. Additionally, the lift system of the invention does not require any sand removal or filtration equipment.

Additionally, the jet-gas lift system of the invention does not require any mechanical moving parts to be located downhole. All moving parts of the system may be located at the surface so that there is no need for retrieval, repair or replacement of pumps, pump components, valves, etc., as with the prior art systems. Indeed, the jet-gas lift system has few moving parts of any kind that might be prone to wear or damage compared to other pumping and lift systems.

While the jet-gas lift system is shown being used and has particular application in lifting liquid oil in oil wells, it can be used for other uses and different liquids, such as water wells, sumps, etc. In such cases, different gases that are compatible with the application may be used for the jet gas.

While the invention has been shown in only some of its forms, it should be apparent to those skilled in the art that it is not so limited, but is susceptible to various changes and modifications without departing from the scope of the invention. Accordingly, it is appropriate that the appended claims be construed broadly and in a manner consistent with the scope of the invention.

I claim:

1. A system for lifting well fluids to a surface location from a subterranean formation that is penetrated by a wellbore, the wellbore being perforated to allow fluids from a producing zone of the subterranean formation to flow into the wellbore, the system comprising:

a tubing string extending from a wellhead of the well and positioned within the wellbore for withdrawing well fluids from the wellbore, the tubing string having a lower inlet for introduction of well fluids into the tubing string and an upper outlet located at a surface location for discharging fluids conducted through the tubing string, the lower inlet of the tubing string being located at a position below the wellhead and above the uppermost perforations of the producing zone, and being at a distance of 50 feet or more above one of 1) the lowermost perforations of a vertical well and 2) the point where a horizontal portion of the wellbore meets a vertical portion of the wellbore in a horizontal well; and a jet-gas pump comprising:

a flow tube having an inlet that is in fluid communication with the upper outlet of the tubing string and a flow tube outlet, the flow tube having a constriction with an orifice having a defined cross-sectional flow area that constricts the flow area within the flow tube between the flow tube inlet and outlet; and a jet tube located within the interior of the flow tube, the jet tube having an inlet for introducing a compressed gas into the interior of the flow tube from a location exterior of the flow tube, the jet tube having an outlet that is aligned with and terminates at or adjacent to the orifice of the constriction, the outlet of the jet tube having a defined cross-sectional flow area that is less than the cross-sectional flow area of the orifice of the constriction; and wherein the flow of compressed gas from the outlet of the jet tube creates a pressure drop within the flow tube that facilitates the lifting of well fluids from the lower inlet of the tubing string to the upper outlet of the tubing string and through the flow tube outlet.

2. The system of claim 1, wherein:

the jet tube is selectively movable in relation to the flow tube so that the outlet can be selectively positioned at different positions relative to the orifice of the constriction.

3. The system of claim 1, wherein:

the outlet of the jet tube is positioned downstream from the orifice of the constriction.

4. The system of claim 1, wherein:

the outlet of the jet tube is positioned upstream of the orifice of the constriction.

5. The system of claim 1, further comprising:

a gas/liquid separator fluidly coupled to the flow tube outlet for separating gases and liquids.

6. The system of claim 1, further comprising:

a compressor fluidly coupled to the jet tube inlet.

7. The system of claim 1, wherein:

the lower inlet of the tubing string is located at least 50 feet above the uppermost perforations of the producing zone.

8. The system of claim 7, wherein:

the lower inlet of the tubing string is located at least 300 feet above the uppermost perforations of the producing zone.

9. The system of claim 1, wherein:

the tubing string is surrounded by an annulus, the annulus being closed off at an upper end of the annulus to facilitate pressurizing the annulus during the lifting of well fluids.

10. The system of claim 1, wherein:

ratio of the cross-sectional flow area of the flow tube to the cross-sectional flow area of the orifice of the constriction is from 1.5:1 to 3:1.

11. The system of claim 1, wherein:

the ratio of the cross-sectional flow area of the orifice of the constriction to the cross-sectional area of the outlet of the jet tube is from 2:1 to 6:1.

12. A method of lifting well fluids to a surface location from a subterranean formation that is penetrated by a wellbore, a tubing string being positioned within the wellbore for withdrawing well fluids from the wellbore, the tubing string having a lower inlet for introduction of well fluids from the formation into the tubing string and an upper outlet located at a surface location for discharging fluids conducted from the lower inlet through the tubing string, the method comprising:

providing a jet-gas pump comprising:

a flow tube having an inlet that is in fluid communication the upper outlet of the tubing string and a flow tube outlet, the flow tube having a constriction with an orifice having a defined cross-sectional flow area that constricts the flow area within the flow tube between the flow tube inlet and outlet; and a jet tube located within the interior of the flow tube, the jet tube having an inlet for introducing a compressed gas into the interior of the flow tube from a location exterior of the flow tube, the jet tube having an outlet that is aligned with and terminates at or adjacent to the orifice of the constriction, the outlet of the jet tube having a defined cross-sectional flow area that is less than the cross-sectional flow area of the orifice of the constriction; and wherein introducing a compressed gas into the inlet of the jet tube so that the compressed gas is discharged out the outlet of the jet tube and creates a pressure drop within the flow tube so that well fluids are lifted from the lower inlet of the tubing string to the upper outlet of the tubing string and through the flow tube outlet, and wherein the tubing string is surrounded by an annulus, the annulus being closed off at an upper end of the annulus at the wellhead to facilitate pressurizing the annulus during the lifting of well fluids without introducing pressurized gas from a surface location into the wellbore through the upper end of the annulus.

13. The system of claim 12, wherein:

the jet tube is selectively movable in relation to the flow tube so that the outlet can be selectively positioned at different positions relative to the orifice of the constriction.

14. The system of claim 12, wherein:

the outlet of the jet tube is positioned downstream from the orifice of the constriction.

15. The system of claim 12, wherein:

the outlet of the jet tube is positioned upstream of the orifice of the constriction.

16. The system of claim 12, further comprising:

introducing the well fluids discharged from the flow tube outlet to a gas/liquid separator that is fluidly coupled to the flow tube outlet to separate gases and liquids from the well fluids.

17. The system of claim 16, further comprising:

at least a portion of the gases separated from the well fluids is used as the compressed gas that is introduced into the inlet of the jet tube.

18. The system of claim 12, wherein:

the wellbore is perforated to allow fluids from a producing zone of the subterranean formation to flow into the wellbore, and wherein the lower inlet of the tubing string is located at a position within the wellbore below the upper outlet of the tubing string and above the uppermost perforations of the producing zone.

19. The system of claim 18, wherein:

the lower inlet of the tubing string is located a distance of 50 feet or more above one of 1) the lowermost perforations of a vertical well and 2) from the point where a horizontal portion of the wellbore meets a vertical portion of the wellbore in a horizontal well.

20. The system of claim 12, wherein:

the lower inlet of the tubing string is located within the wellbore below the upper outlet of the tubing string and at least 50 feet above the uppermost perforations of the producing zone.

21. The system of claim 12, further comprising:

monitoring a liquid level within the wellbore and controlling the jet gas pump in response to the monitored liquid level to maintain the liquid level at a selected level.

22. The system of claim 12, wherein:

ratio of the cross-sectional flow area of the flow tube to the cross-sectional flow area of the orifice of the constriction is from 1.5:1 to 3:1.

23. The system of claim 12, wherein:

the ratio of the cross-sectional flow area of the orifice of the constriction to the cross-sectional area of the outlet of the jet tube is from 2:1 to 6:1.

24. A system for lifting well fluids to a surface location from a subterranean formation that is penetrated by a wellbore, the system comprising:

a wellhead positioned above the wellbore at the surface location for withdrawing well fluids from the wellbore, the wellhead having a fluid flow inlet located 50 feet or less from the wellhead and from 50 feet or more from an uppermost producing zone of the formation; and a jet-gas pump comprising:

a flow tube having an inlet that is in fluid communication with the inlet of the wellhead and a flow tube outlet, the flow tube having a constriction with an orifice having a defined cross-sectional flow area that constricts the flow area within the flow tube between the flow tube inlet and outlet; and a jet tube located within the interior of the flow tube, the jet tube having an inlet for introducing a compressed gas into the interior of the flow tube from a location exterior of the flow tube, the jet tube having an outlet that is aligned with and terminates at or adjacent to the orifice of the constriction, the outlet of the jet tube having a defined cross-sectional flow area that is less than the cross-sectional flow area of the orifice of the constriction; and wherein the flow of compressed gas from the outlet of the jet tube creates a pressure drop within the flow tube that facilitates the lifting of well fluids from the inlet of the wellhead to the flow tube inlet and through the flow tube outlet.

* * * * *